US012151151B2

(12) United States Patent
Sweeney et al.

(10) Patent No.: US 12,151,151 B2
(45) **Date of Patent: *Nov. 26, 2024**

(54) ADJUSTABLE-INCLINE CLIMBING WALL

(71) Applicant: Everlast Climbing Industries, Inc., Crystal, MN (US)

(72) Inventors: Joseph Sweeney, Minneapolis, MN (US); Timothy Sudeith, Edina, MN (US); Sarah Mae Howard, Lakeville, MN (US); Benjamin Tiffin, Missoula, MT (US)

(73) Assignee: EVERLAST CLIMBING INDUSTRIES, INC., Crystal, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/345,051

(22) Filed: Jun. 30, 2023

(65) Prior Publication Data

US 2023/0347223 A1 Nov. 2, 2023

Related U.S. Application Data

(63) Continuation of application No. 17/376,941, filed on Jul. 15, 2021, now Pat. No. 11,731,020.
(Continued)

(51) Int. Cl.
*A63B 69/00* (2006.01)

(52) U.S. Cl.
CPC ..... *A63B 69/0048* (2013.01); *A63B 2225/09* (2013.01)

(58) Field of Classification Search
CPC ..... A63B 69/0048; A63B 24/0062; A63B 24/0075; A63B 71/0622; A63B 2071/063;
(Continued)

(56) References Cited

U.S. PATENT DOCUMENTS 3,741,538 A * 6/1973 Lewis ..... A63B 21/4043 482/133
5,549,195 A 8/1996 Aulagner et al.
(Continued)

FOREIGN PATENT DOCUMENTS

BE 905390 12/1986
DE 3739702 6/1989
(Continued)

OTHER PUBLICATIONS

Removable Climbing Hold Bracket (No Hold), Atomik Climbing Holds, dated May 5, 2016, 1 page, retrieved from the internet: https://www.atomikclimbingholds.com/removable-climbing-hold (Year: 2016).

(Continued)

*Primary Examiner* — Loan B Jimenez
*Assistant Examiner* — Andrew M Kobylarz
(74) *Attorney, Agent, or Firm* — McAndrews, Held & Malloy, Ltd.

(57) ABSTRACT

The present disclosure is directed to an adjustable-incline climbing wall. The climbing wall comprises a climbing surface and a system for adjusting the climbing surface to a desired incline. By positioning the pivot point for the climbing surface in front of the bottom edge of the climbing surface, embodiments of the climbing wall minimize or eliminate the unusable "dead space" at the bottom of the climbing surface that is created when conventional adjustable climbing walls are placed at higher angles of incline. Moreover, by angling the legs of the support structure outward, embodiments of the climbing wall provide for an extended fall area that is free from obstructions, providing enhanced climber safety. Finally, embodiments of the climbing wall are freestanding structures, which are easily install-
(Continued)

able in a climber's home or personal gym without damage to floors or walls.

15 Claims, 9 Drawing Sheets

Related U.S. Application Data

(60) Provisional application No. 63/160,349, filed on Mar. 12, 2021, provisional application No. 63/052,193, filed on Jul. 15, 2020.

(58) Field of Classification Search
CPC ..... A63B 2071/0647; A63B 2209/00; A63B 2220/56; A63B 2220/806; A63B 2225/20; A63B 6/00; A63B 24/0003; A63B 71/021; A63B 71/023; A63B 2024/0025; A63B 2071/024; A63B 2071/0625; A63B 2071/0655; A63B 2220/80; A63B 2220/801; A63B 2220/808; A63B 2220/833; A63B 2225/09; A63B 2225/093; A63B 2225/10; A63B 2225/50; A63B 2225/60; A63B 2225/74
See application file for complete search history.

(56) References Cited

U.S. PATENT DOCUMENTS

| | | | | |
|---|---|---|---|---|
| 6,231,482 | B1 | 5/2001 | Thompson | |
| 6,551,215 | B1 | 4/2003 | Gordon | |
| 6,860,836 | B1 | 3/2005 | Wu | |
| 6,872,167 | B1 * | 3/2005 | Meissner | A63B 69/0048 482/37 |
| 7,195,582 | B2 * | 3/2007 | Wu | A63B 22/001 482/37 |
| 7,686,739 | B2 | 3/2010 | Vanamo | |
| 7,727,118 | B1 | 6/2010 | McCall | |
| 7,731,632 | B2 | 6/2010 | Wu | |
| 7,762,928 | B2 * | 7/2010 | Meissner | A63B 69/0048 482/37 |
| 8,668,626 | B1 | 3/2014 | Horowitz et al. | |
| 9,017,224 | B1 * | 4/2015 | Singley | A63B 22/0005 482/52 |
| 9,132,330 | B2 | 9/2015 | Brendle | |
| 9,600,716 | B2 | 3/2017 | Skjaerseth et al. | |
| 10,232,243 | B2 | 3/2019 | Bowers | |
| 10,918,925 | B2 * | 2/2021 | Sudeith | A63B 69/0048 |
| 2002/0169052 | A1 | 11/2002 | Godsey | |
| 2003/0228956 | A1 | 12/2003 | Paci | |
| 2004/0229732 | A1 | 11/2004 | Wang et al. | |
| 2008/0293547 | A1 | 11/2008 | Moy et al. | |
| 2013/0324383 | A1 | 12/2013 | Rogers | |
| 2014/0200122 | A1 | 7/2014 | Hallmark | |
| 2019/0009157 | A1 | 1/2019 | Sudeith et al. | |
| 2020/0023257 | A1 * | 1/2020 | Speed | A63B 69/0048 |
| 2020/0114190 | A1 * | 4/2020 | Tuller | A63B 1/00 |
| 2021/0275888 | A1 * | 9/2021 | Speed | A63B 24/0003 |

FOREIGN PATENT DOCUMENTS

| | | | | |
|---|---|---|---|---|
| DE | 102005063225 | * 12/2005 | | A63B 9/00 |
| DE | 202007014591 | 3/2008 | | |
| ES | 2208074 | 6/2004 | | |
| FR | 2613945 | 10/1988 | | |
| FR | 2682606 | 4/1993 | | |
| FR | 2744638 | 8/1997 | | |
| FR | 2977501 | 1/2013 | | |
| WO | 1989009635 | 10/1989 | | |
| WO | 9108806 | 6/1991 | | |
| WO | 9531257 | 11/1995 | | |

OTHER PUBLICATIONS http://edgiegear.com/flat-face-4-with-hand-hold/.
https://s-media-cache-ak0.pinimg.com/736x/d0/74/04/d074048fb21cf789b1b80f19996c805c.jpg.
http://www.top30climbingwalls.com/climbing-walls-around-the-world-climbingwalls-climbing-walls/accessories/rock--home_1103_80_1108_0_1_in.html.
https://s-media-cache-ak0.pinimg.com/originals/f6/68/f3/f668f34dae7ba1bb52a5eccedacc00f5.jpg.
http://www.supertopo.com/photos/1/82/139698_19584_L.jpg.
https://web.archive.org/web/20200505203618/https:/grasshopperclimbing.com.
Vertical Solutions' (ATP) Adjustable Training Platform, by Vertical Solutions, May 9, 2018, 3 pages.
"IFSC Collaborated Field of Play Ready for Route-Setters This Summer", Entre-Prises—Climbing Walls & Holds Manufacturer, https://epclimbing,com/na/en/, 6 pages.

* cited by examiner

ADJUSTABLE-INCLINE CLIMBING WALL

This application is a continuation of U.S. patent application Ser. No. 17/376,941, filed on Jul. 15, 2021, which claims priority to U.S. provisional patent application No. 63/160,349, filed on Mar. 12, 2021, and U.S. provisional patent application No. 63/052,193, filed on Jul. 15, 2020, the entireties of which are incorporated herein by reference.

BACKGROUND

As recreational climbing and competitive climbing grow in popularity, climbers are increasingly seeking to install climbing walls in their homes. For a variety of reasons, climbing walls that have been designed for climbing gyms are not well-suited to home installation. Embodiments of the present invention are directed to a climbing wall that is configured for easy installation in a home environment and that maximizes the amount of useful climbing space given the spatial limitations imposed by such a setting.

SUMMARY OF THE INVENTION

Embodiments of the present disclosure are directed to a climbing wall assembly configured for the climbing surface to be moved to a plurality of different angles, thereby providing a variety of different inclined climbing experiences. The adjustable-incline climbing wall assembly includes one or more climbing panels, the front face or faces of which form a climbing surface. The one or more climbing panels are configured to have a plurality of climbing grips affixed thereto. The climbing grips may be affixed to the one or more climbing panels by means that are well known in the art.

The climbing wall also includes a system for supporting the climbing surface and for adjusting the incline of the climbing surface.

The system includes one or more frame elements attached to the one or more climbing panels, e.g. to the rear face of the one or more climbing panels (the surface opposite the climbing surface). In some embodiments, for instance, the system may include a lower frame element and an upper frame element, each of which is attached to at least one of the one or more climbing panels. In some embodiments, the system may include left frame element and a right frame element, each of which is attached to at least one of the one or more climbing panels. In some embodiments, the lower, upper, left, and/or right frame elements may be positioned around the periphery of the one or more climbing panels.

The system also includes a support structure having first and second legs. Each of the first and second legs spans between a rear end and a front end. In some embodiments, the support structure also includes a crossbar that spans between the first and second legs at or near their rear ends. The first and second legs extend forward from the rear crossbar, such that the climbing surface is disposed between the first and second legs. In this way, the first and second legs act to support the assembly against tipping in response to forces that are placed on the climbing surface during use.

The system also includes one or more actuators. The one or more actuators operate to adjust the incline of the climbing surface to a plurality of angles within a permitted range. In some embodiments, the one or more actuators may operate to place the climbing surface at any angle, or substantially any angle, within the permitted range. In other embodiments, the one or more actuators may operate to place the climbing surface at a plurality of defined angles within the permitted range. In some embodiments, the one or more actuators may be operated automatically, e.g. by a user pressing a button or the like, while in other embodiments, the one or more actuators may be operated manually, e.g. by a hand crank or pin setting. For instance, the one or more actuators may include a pneumatic linear actuator, a hydraulic liner actuator, an electric linear actuator, a hand-cranked linear actuator, or a manually set tube strut.

In some embodiments, each of the one or more actuators has a first end and a second end, the first end being connected to one of the first and second legs and the second end being connected to part of the wall frame, e.g. the upper frame element or one of the left and right frame elements. In some embodiments, for instance, the system may include a first actuator and a second actuator, the first actuator being connected to the first leg and the second actuator being connected to the second leg. In this manner, the one or more actuators may also help support the one or more climbing panels by distributing the forces placed on the climbing surface to a forward point on the legs, which may be particularly important when the climbing surface is placed at higher angles relative to vertical. In some embodiments, for instance, when the climbing surface is at its highest angle relative to vertical, the one or more actuators may be oriented substantially vertically.

In some embodiments, the assembly may have one or more pivot points that are positioned forward from the bottom edge of the climbing surface. In some embodiments, the wall frame, e.g. the lower frame element or the left and right frame elements, may include one or more forward-extending wings, each of which is pivotably connected to one of the first and second support legs. For instance, the wall frame, e.g. the lower frame element or the left and right frame elements, may include first and second forward-extending wings. The first forward-extending wing may be pivotably connected to the first leg at a pivot point positioned forward from the bottom edge of the climbing surface and the second forward-extending wing may be pivotably connected to the second leg at a pivot point positioned forward from the bottom edge of the climbing surface. By placing the pivot points forward of the bottom edge of the climbing surface, embodiments of the climbing wall assembly minimize or eliminate the unusable "dead space" at the bottom of the climbing surface that is created when conventional home-installable, adjustable climbing walls are placed at higher angles of incline.

In order to ensure that the climbing surface pivots consistently (and is not subject to torque), the one or more pivot points should be at the same forward position relative to the climbing surface. For consistency, the location of the pivot point is described herein by reference to the bottom edge of the climbing surface when the climbing surface is at its lowest angle relative to vertical (which may or may not be 0°), though other manners of measuring are also contemplated.

In some embodiments, the one or more pivot points may be positioned at least 3 inches forward of the bottom edge of the climbing surface when the climbing surface is at its lowest angle relative to vertical, alternatively at least 6 inches forward of the bottom edge of the climbing surface when the climbing surface is at its lowest angle relative to vertical, alternatively at least 9 inches forward of the bottom edge of the climbing surface when the climbing surface is at its lowest angle relative to vertical, alternatively at least 12 inches forward of the bottom edge of the climbing surface when the climbing surface is at its lowest angle relative to vertical, alternatively at least 15 inches forward of the bottom edge of the climbing surface when the climbing surface is at its lowest angle relative to vertical, alternatively at least 18 inches forward of the bottom edge of the climbing surface when the climbing surface is at its lowest angle relative to vertical, alternatively at least 24 inches forward of the bottom edge of the climbing surface when the climbing surface is at its lowest angle relative to vertical, alternatively at least 30 inches forward of the bottom edge of the climbing surface when the climbing surface is at its lowest angle relative to vertical, alternatively at least 36 inches forward of the bottom edge of the climbing surface when the climbing surface is at its lowest angle relative to vertical.

By placing the pivot point forward of the bottom edge of the climbing surface, the overall room height requirements of the climbing wall assembly may be kept relatively low without a reduction in the span of climbing surface that is usable when the climbing surface is brought to higher angles relative to vertical. The top edge of the climbing surface is at its highest point when the climbing surface is at its lowest angle relative to vertical. The dimensions of the space in which the climbing wall assembly is installed may typically dictate how high this point may be. By having a bottom edge of the climbing surface close to the ground, e.g. floor, surface when the climbing surface is at its lowest angle relative to vertical, therefore, the span of climbing surface available to a climber may be maximized. However, when the climbing surface is brought to higher angles relative to vertical, a bottom edge of the climbing surface that is close to the ground surface creates a narrow gap between a bottom portion of the climbing surface and the ground surface, which acts as a "dead space" toward the bottom of the climbing surface that cannot be used by a climber. Embodiments of the climbing wall assembly disclosed herein are configured to raise the bottom edge of the climbing surface when it is brought to higher angles (relative to vertical), thereby eliminating this unusable dead space and maximizing the span of climbing surface available to a climber when the surface is placed at higher angles. In this way, embodiments of the climbing wall assembly maximize the span of climbing surface available to a climber, e.g. ensure that the same span of climbing surface is available, within/throughout the permitted range of climbing surface inclines.

In some embodiments, for instance, the bottom edge of the climbing surface may be positioned at least 8 inches above the ground surface when the climbing wall is placed at its highest permitted angle relative to vertical, alternatively at least 10 inches above the ground surface when the climbing wall is placed at its highest permitted angle relative to vertical, alternatively at least 12 inches above the ground surface when the climbing wall is placed at its highest permitted angle relative to vertical, alternatively at least 14 inches above the ground surface when the climbing wall is placed at its highest permitted angle relative to vertical, alternatively at least 15 inches above the ground surface when the climbing wall is placed at its highest permitted angle relative to vertical, alternatively at least 16 inches above the ground surface when the climbing wall is placed at its highest permitted angle relative to vertical, alternatively at least 17 inches above the ground surface when the climbing wall is placed at its highest permitted angle relative to vertical, alternatively at least 18 inches above the ground surface when the climbing wall is placed at its highest permitted angle relative to vertical.

In any of those same embodiments, the bottom edge of the climbing surface may be positioned within 12 inches of the ground surface when the climbing surface is placed at its lowest permitted angle relative to vertical, alternatively within 10 inches of the ground surface when the climbing surface is placed at its lowest angle relative to vertical, alternatively within 8 inches of the ground surface when the climbing surface is placed at its lowest angle relative to vertical, alternatively within 6 inches of the ground surface when the climbing surface is placed at its lowest angle relative to vertical, alternatively within 5 inches of the ground surface when the climbing surface is placed at its lowest angle relative to vertical, alternatively within 4 inches of the ground surface when the climbing surface is placed at its lowest angle relative to vertical, alternatively within 3 inches of the ground surface when the climbing surface is placed at its lowest angle relative to vertical, alternatively within 2 inches of the ground surface when the climbing surface is placed at its lowest angle relative to vertical.

In some embodiments, the assembly may further comprise a kicker board. The kicker board may be supported, for instance, by the rear crossbar and may be positioned between the rear ends of the first and second legs. In embodiments in which the pivot point for the climbing surface is in a forward position, the kicker board may be at least partially disposed behind a portion of the climbing surface when the climbing surface is at its lowest angle relative to vertical. As the climbing surface is moved to higher angles (again, relative to vertical), the kicker board may become exposed for use by a climber.

In some embodiments, the climbing assembly may be configured so that the space directly underneath the climbing surface is free of obstruction by any portion of the support structure, regardless of what angle the climbing surface is brought to. Further, in some embodiments, the first and second legs may be angled outward, such that the distance between a front end of the first leg and a front end of the second leg is greater than the distance between a rear end of the first leg and a rear end of the second leg. By angling the legs of the support structure outward, embodiments of the climbing wall assembly provide for an extended fall area underneath the climbing surface that is free from obstructions, which further improves climber safety.

Angling of the legs outward, however, creates additional complexity in moving the climbing surface to different angles. For instance, the angling of the actuators in a direction other than that in which the climbing surface pivots would place torque on the actuators during operation and use of the wall. In some embodiments of the climbing wall assembly, therefore, the wall frame may include one or more elements that extend outward beyond the sides of the climbing surface, and to which the actuators may be connected. In some embodiments, for instance, a first end of the upper frame element may extend outward beyond a first side of the climbing surface and/or a second end of the upper frame element may extend outward beyond a second side of the climbing surface, and the one or more actuators may be connected to the extending portion(s) of the frame element, such that the one or more actuators are aligned with the direction in which the climbing surface pivots. Angling of the legs may also require that, at least in some embodiments, each of the forward-extending wings are angled outward, such that a front end of the wing (which is pivotably attached to a support leg) is positioned outward from a rear end of the wing (which is connected to the wall frame, e.g. to a crossbar that spans between the first and second wings).

In some embodiments, the adjustable-incline climbing wall assembly may be a freestanding unit. By this, it is meant that the climbing wall assembly need not be secured to a ground surface, e.g. a floor, or a structural support wall by fasteners or the like. In this manner, embodiments of the climbing wall assembly may be easily installable in a climber's home or personal gym without damage to floors or walls. In other embodiments, however, the climbing wall assembly may be secured to a ground surface on which it is installed and/or a structural support wall.

Embodiments of the adjustable-incline climbing wall may also be configured to have minimal space requirements. In some embodiments, for example, when the climbing surface is at its lowest angle relative to vertical, the bottom edge of the climbing surface may be within 12 inches of the rearmost point of the climbing wall assembly 10, alternatively within 10 inches of the rearmost point of the climbing wall assembly, alternatively within 8 inches of the rearmost point of the climbing wall assembly, alternatively within 6 inches of the rearmost point of the climbing wall assembly, alternatively within 4 inches of the rearmost point of the climbing wall assembly. In this manner, embodiments of the climbing wall assembly may be installed in a wide variety of room sizes, making it suitable for installation in homes having varying amounts of available space.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Figure 1:
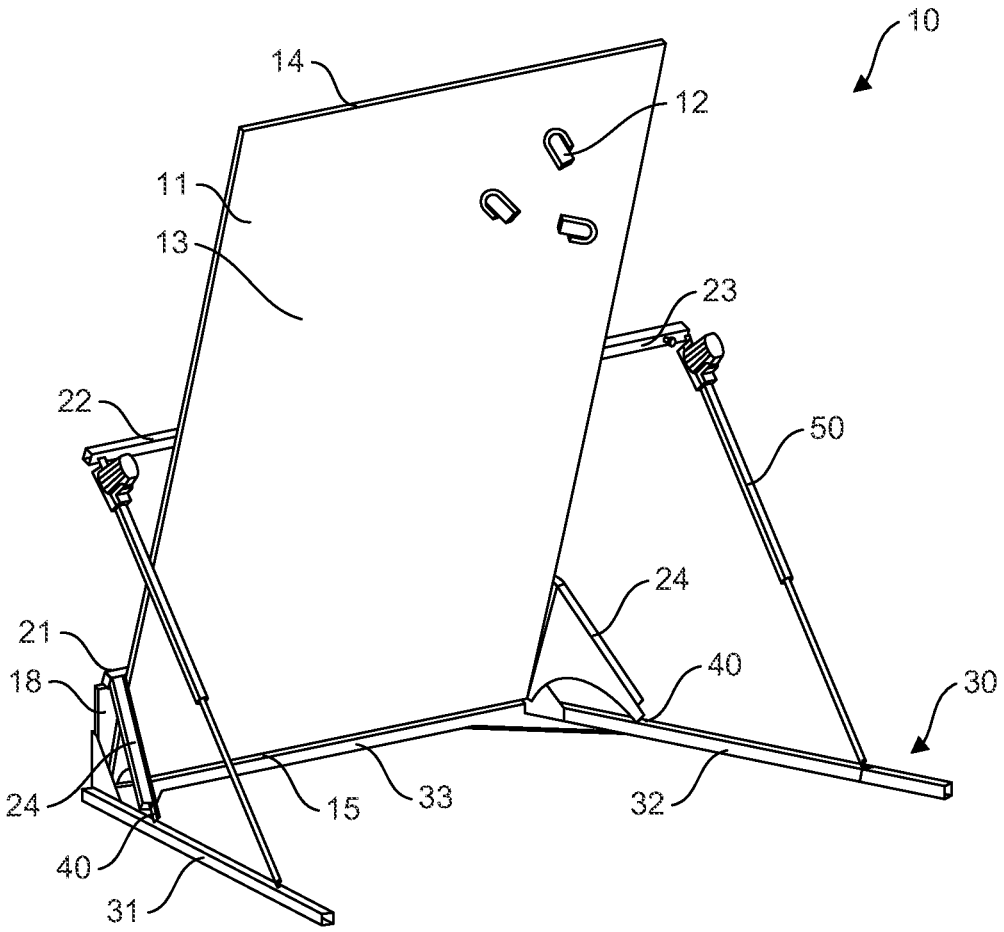
FIG. 1 is a front perspective view of an embodiment of a climbing wall of the present disclosure, showing the climbing surface at an incline of about 20° from vertical.

Embodiments of the present disclosure are directed to an adjustable-incline climbing wall assembly 10.

Embodiments of the adjustable-incline climbing wall assembly 10 disclosed herein comprise one or more climbing panels 11 containing a plurality of climbing grips 12. The front face(s) of the one or more climbing panels 11 that contains the plurality of climbing grips 12 is known as the climbing surface 13. In some embodiments, the climbing surface 13 may be formed by a single climbing panel 11. In other embodiments, multiple climbing panels 11 may be aligned with one another to form a substantially continuous climbing surface 13. The surface(s) of the one or more climbing panels 11 that make up the climbing surface 13 may be textured or may be smooth. A plurality of climbing grips 12 are affixed to the one or more climbing panels 11 and extend from the climbing surface 13. The plurality of climbing grips 12 may have a variety of configurations, as is generally understood by those of skill in the art. The one or more climbing grips 12 are not, for instance, limited to those shown in any of the illustrated embodiments.

Though not illustrated, in some embodiments, the one or more climbing panels 11 may be attached to a structural framework to provide increased structural stability. For instance, the rear face(s) of the one or more climbing panels 11, i.e. the faces opposite the climbing surface 13, may be attached to a framework. The framework may have any of a variety of configurations. In some embodiments, for instance, the framework may comprise a rectangular structure that is dimensioned to substantially correspond with the periphery of the climbing surface 13, such as that described and shown in United States Patent Application Publication No. US 2019/0009157 A1, the entirety of which is incorporated by reference herein. The framework may also comprise one or more strengthening crossbars that span between opposing sides of the framework.

Embodiments of the adjustable-incline climbing wall assembly 10 disclosed herein also comprise a system for supporting the climbing wall and for adjusting the incline of the climbing wall.

In some embodiments, such as that illustrated in FIGS. 1 through 4, the system may include one or more frame elements attached to the rear face of the one or more climbing panels 11, i.e. the surface opposite the climbing surface 13. The one or more frame elements may take on any of a variety of configurations. In some embodiments, for instance, the system may include a lower frame element 21 and an upper frame element 22, each of which is attached to at least one of the one or more climbing panels 11. As shown in the illustrated embodiment, each of the lower frame element 21 and the upper frame element 22 may comprise a crossbar that spans at least between a first side of the climbing surface and a second side of the climbing surface. In fact, in some embodiments, at least one of the lower frame element 21 and the upper frame element 22 may comprise a crossbar that extends beyond the climbing surface 13 on the first side, the second side, or both. In the illustrated embodiment, for instance, the upper frame element 22 comprises a crossbar having portions 23 that extend beyond each side of the climbing surface 13.

The lower frame element 21 may also comprise one or more wings 24 that pivotably connect the climbing wall to a support structure 30. For instance, in some embodiments, the lower frame element 21 may include one or more forward-extending wings 24, each of which is pivotably connected to the support structure 30, and more particularly to a first leg 31 or a second leg 32 of the support structure. As shown in the illustrated embodiment, for example, the lower frame element 21 may include first and second forward-extending wings 24. The first forward-extending wing 24 may be pivotably connected to the first leg 31 at a pivot point 40 positioned forward from the bottom edge of the climbing surface 15 and the second forward-extending wing 24 may be pivotably connected to the second leg 32 at a pivot point positioned forward from the bottom edge of the climbing surface. By placing the pivot points 40 forward of the bottom edge of the climbing surface 15, embodiments of the climbing wall assembly 10 minimize or eliminate the unusable "dead space" at the bottom of the climbing surface 13 that is created when conventional home-installable, adjustable climbing walls are placed at higher angles of incline.

In some embodiments, the pivot points 40 may be positioned at least 6 inches forward of the bottom edge of the climbing surface 15 when the climbing surface is at its lowest angle relative to vertical, alternatively at least 12 inches forward of the bottom edge of the climbing surface when the climbing surface is at its lowest angle relative to vertical, alternatively at least 18 inches forward of the bottom edge of the climbing surface when the climbing surface is at its lowest angle relative to vertical, alternatively at least 20 inches forward of the bottom edge of the climbing surface when the climbing surface is at its lowest angle relative to vertical, alternatively at least 24 inches forward of the bottom edge of the climbing surface when the climbing surface is at its lowest angle relative to vertical, alternatively at least 26 inches forward of the bottom edge of the climbing surface when the climbing surface is at its lowest angle relative to vertical, alternatively at least 28 inches forward of the bottom edge of the climbing surface when the climbing surface is at its lowest angle relative to vertical, alternatively at least 30 inches forward of the bottom edge of the climbing surface when the climbing surface is at its lowest angle relative to vertical, alternatively at least 32 inches forward of the bottom edge of the climbing surface when the climbing surface is at its lowest angle relative to vertical. As an upper threshold, the pivot points should generally be positioned within the rear half of the first and second legs 31, 32.

Where the lower frame element 21 comprises a crossbar, each wing 24 may be affixed to the crossbar or integral with the crossbar or a portion of the crossbar. In embodiments in which the climbing wall comprises an additional framework, each wing 24 may be affixed to, or integral with that framework or a portion of that framework. In the illustrated embodiment, the lower frame element 21 comprises a crossbar that extends slightly beyond the sides of the climbing surface 13 and each wing 24 is fixedly attached to the portion of the crossbar that extends beyond the side of the climbing surface. In other embodiments, however, the wings 24 may have one or more bent or curved portions that extend behind the climbing surface and are fixedly attached to another portion of the lower frame element 21, to a more extensive climbing panel support framework described above, or to the rear face of at least one of the one or more climbing panels 11.

Similarly, the forward-extending wings 24 themselves may take on any of a variety of configurations. For instance, in the illustrated embodiment, each of the first and second forward-extending wings 24 are angled outward, such that a front end of the wing (which is pivotably attached to a support leg 31, 32) is positioned outward from a rear end of the wing (which is fixedly connected to the another portion of the lower frame element 21, e.g. to a crossbar that spans between the first and second wings). In other embodiments, however, the forward-extending wings 24 may extend directly forward, i.e. the front end of the wing may be in line with the rear end of the wing when the climbing wall assembly 10 is viewed from the front (e.g. in embodiments where the first and second support legs 31, 32 are not angled outward).

Though the configuration of the lower frame element 21 and the upper frame element 22 of the embodiment illustrated in FIGS. 1-4 are shown described herein, the exact configurations of the lower frame element and the upper frame element are not limited by the illustrated embodiment. As one example, in some embodiments, the lower frame element 21 and the upper frame element 22 may be part of a more extensive climbing panel 11 support framework described above. Further, the exact positioning of the lower and upper frame elements 21, 22 is not limited by the illustrated embodiment. For instance, in some embodiments, the upper frame element 22 may be positioned within the upper half of the climbing surface 13 (measured between the top edge 14 and the bottom edge 15), though such a placement is by no means required.

In other embodiments, the forward-extending wings 24 may be omitted and the pivoting of the climbing wall may be provided by a conventional hinge at the bottom edge of the climbing surface 13, e.g. as described and shown in United States Patent Application Publication No. US 2019/0009157 A1, the entirety of which is incorporated by reference herein. While this embodiment would not provide all of the benefits described herein, it could nevertheless serve as an easily-installable home climbing wall assembly 10 and one that could be configured to provide enhanced climber safety, e.g. through the angling outward of the support legs 31, 32.

In some embodiments, such as that illustrated in FIGS. 1 through 4, the system may also include a support structure 30. The support structure 30 may comprise a first leg 31, a second leg 32, and a rear crossbar 33 that connects the first and second legs to one another. The first and second legs 31, 32 may extend forward from the rear crossbar 33, such that the climbing surface 13 is disposed between the first and second legs. In this way, the first and second legs 31, 32 act to support the climbing wall assembly 10 against tipping in response to forces that are placed on the climbing surface 13 during use.

The first and second legs 31, 32 desirably extend forward a sufficient distance to provide adequate stability (the further forward they extend, the greater the stability of the assembly when the climbing surface is placed at high angles relative to vertical). In some embodiments, the first and second legs 31 extend forward a sufficient distance that they cover at least 60%, alternatively at least 70%, alternatively at least 75%, alternatively at least 80%, alternatively at least 85%, alternatively at least 90% of the overall front to rear dimension of the assembly 10, i.e. the distance between the most rearward point of the assembly 10, which may be the rear surface of the croosbar 33, and the most forward point of the assembly, typically the upper edge 14 of the climbing surface when the climbing surface 13 is placed at its maximum permitted angle relative to vertical. An example of this relationship can be seen in FIG. 3.

In some embodiments, the first and second legs 31, 32 may extend directly forward from the rear crossbar, i.e. the front end of the leg may be in line with the rear end of the leg such that the distance between the front ends of the first and second legs is the same or substantially the same as the distance between the rear ends of the first and legs. In other embodiments, including the embodiment illustrated in FIGS. 1-4, however, the first and second legs 31, 32 may be angled outward, such that the distance between a front end of the first leg and a front end of the second leg is greater than the distance between a rear end of the first leg and a rear end of the second leg. By angling the legs 31, 32 of the support structure 30 outward, embodiments of the climbing wall assembly 10 provide for an extended fall area underneath the climbing surface 13 that is free from obstructions, which further improves climber safety. In some embodiments, for instance, the first and second legs 31, 32 may be angled greater than 90° with respect to the crossbar 33 (or with respect to the bottom edge 15 of the climbing surface 13, e.g. if no crossbar is present), alternatively at least about 91° with respect to the crossbar, alternatively at least about 92° with respect to the crossbar, alternatively at least about 93° with respect to the crossbar, alternatively at least about 94° with respect to the crossbar, alternatively at least about 95° with respect to the crossbar. alternatively at least about 96° with respect to the crossbar, alternatively at least about 97° with respect to the crossbar, alternatively at least about 98° with respect to the crossbar, alternatively at least about 99° with respect to the crossbar, alternatively at least about 100° with respect to the crossbar. In the embodiment illustrated in FIGS. 1-4, for instance, the first and second legs 31, 32 are angled about 102 degrees with respect to the crossbar 33.

In some embodiments, including but not limited to the illustrated embodiment, the support structure 30 is configured so that the space directly underneath the climbing surface 13 is free of obstruction by any portion of the support structure 30, regardless of what angle the climbing surface is brought to. In this way, should a climber choose to use the climbing wall without safety pads (which we are not recommending), he or she could do so more safely. Moreover, if safety pads are to be used, the lack of an obstruction by the support structure 30 makes it easier to bring the safety pads into and out of place.

In some embodiments, the assembly may further comprise a kicker board 18. As shown in the illustrated embodiment, the kicker board 18 may be supported, for instance, by the rear crossbar 33 and may be positioned between the rear ends of the first and second legs 31, 32. In embodiments in which the pivot point 40 for the climbing surface 13 is in a forward position, the kicker board 18 may be at least partially disposed behind a portion of the climbing surface 13 when the climbing surface is at its lowest angle relative to vertical, as shown for example in FIGS. 1-2. As the climbing surface 13 is moved to higher angles relative to vertical, however, the kicker board 18 may become exposed for use by a climber, as shown for example in FIGS. 3-4. In embodiments in which the pivoting of the climbing wall is provided by a conventional hinge at the bottom edge of the climbing surface 13, the kicker board 18 may be positioned directly below that hinge, e.g. as described and shown in United States Patent Application Publication No. US 2019/0009157 A1, the entirety of which is incorporated by reference herein (or, of course, the kicker 18 may be omitted).

The system may also include one or more actuators 50. The one or more actuators 50 operate to adjust the incline of the climbing surface 13 to a plurality of angles within a permitted range. In some embodiments, the one or more actuators 50 may operate to place the climbing surface 14 at any angle, or substantially any angle, within the permitted range. In other embodiments, the one or more actuators 50 may operate to place the climbing surface 13 at a plurality of defined angles within the permitted range.

In some embodiments, for example, the climbing wall assembly 10 may be configured so that the climbing surface 13 may be inclined at a plurality of angles within a range that includes at least between about 30° and about 50° relative to vertical. More desirably, the climbing wall assembly 10 may be configured so that the climbing surface 13 may be inclined at a plurality of angles within a range that includes at least between about 25° and about 55° relative to vertical. More desirably, the climbing wall assembly 10 may be configured so that the climbing surface 13 may be inclined at a plurality of angles within a range that includes at least between about 20° and about 60° relative to vertical.

In some embodiments, the climbing wall assembly 10 may be configured so that the lowest permitted angle relative to vertical to which the climbing surface 13 may be placed is 0°, i.e. the climbing surface may be brought to vertical. In other embodiments, however, the climbing wall assembly may be configured so that the lowest permitted angle relative to vertical to which the climbing surface 13 may be placed is between 0° and 25°, alternatively between 0° and 23°, alternatively between 0° and 20°, alternatively between 5° and 25°, alternatively between 5° and 23°, alternatively between 5° and 20°, alternatively between 10° and 25°, alternatively between 10° and 23°, alternatively between 10° and 20°, alternatively between 15° and 25°, alternatively between 15° and 23°, alternatively between 15° and 20°. In some embodiments, it may be desirable to have a lowest permitted angle relative to vertical that is not zero, e.g. that is within one of the other above-identified ranges, in order to limit the overall height requirements of the climbing wall assembly 10, such as where it may be installed in a room having a ceiling height limitation. In the embodiment illustrated in FIGS. 1-4, for example, the lowest permitted angle relative to vertical to which the climbing surface may be placed is between 15° and 20° and more particularly is about 18°.

In some embodiments, the climbing wall assembly 10 may be configured so that the highest permitted angle relative to vertical to which the climbing surface 13 may be placed is 90°, i.e. the climbing surface may be brought to horizontal. In other embodiments, however, the climbing wall assembly may be configured so that the highest permitted angle relative to vertical to which the climbing surface 13 may be placed is between 90° and 50°, alternatively between 90° and 55°, alternatively between 90° and 60°, alternatively between 90° and 65°, alternatively between 90° and 70°, alternatively between 80° and 50°, alternatively between 80° and 55°, alternatively between 80° and 60°, alternatively between 80° and 65°, alternatively between 80° and 70°, alternatively between 75° and 50°, alternatively between 75° and 55°, alternatively between 75° and 60°, alternatively between 75° and 65°. In some embodiments, it may be desirable to have a highest permitted angle relative to vertical that is not 90°, e.g. that is within one of the other above-identified ranges, in order to limit the overall dimensional requirements of the climbing wall assembly 10, such as where it may be installed in a room having dimensional limitations or where it was simply not desired to have a wall that could be brought to horizontal. In the embodiment illustrated in FIGS. 1-4, for example, the highest permitted angle relative to vertical to which the climbing surface may be placed is between 65° and 75° and more particularly is about 70°.

In some embodiments, the lowest permitted angle relative to vertical to which the climbing surface 13 may be placed, the highest permitted angle relative to vertical to which the climbing surface may be placed, or both, may be predefined (e.g. by design) or fixed during installation (e.g. to satisfy room height and/or dimensional limitations). In other embodiments, the lowest permitted angle relative to vertical to which the climbing surface 13 may be placed, the highest permitted angle relative to vertical to which the climbing surface may be placed, or both, may be adjustable. For instance, in some embodiments, the actuators 50 may be set by a user to provide for movement of the climbing wall within a desired permitted range of angles, including for example any combination of the above.

In some embodiments, the climbing wall assembly 10 may be provided with an angle indicator, by which a user can easily see the angle of the climbing surface 13.

The actuator 50 may be any linear actuator that is capable of withstanding at least a minimum required amount (for example 200 in-lbs.) of force, such as may be placed on it during use of the climbing wall in an inclined position.

The actuator 23 may be a pneumatic linear actuator, a hydraulic liner actuator, an electric linear actuator, or a screw-driven (e.g. a ball-screw) actuator. In some embodiments, electric or hydraulic actuators may be preferred. In some embodiments, the actuator 50 may be automatically activated by a user through a relatively simple user interface. For example, the climbing wall assembly 10 may comprise at least one button, switch, lever, knob, etc., or any combination thereof. For instance, a user may depress a first button to cause the actuator 50 to extend and a second button to cause the actuator to retract. Or a user may pull a lever, turn a knob, flip a switch, etc. in one of two directions to cause the actuator 50 to extend (first direction) or retract (second direction). Or a user may pull a lever, turn a knob, flip a switch, etc. in one of two directions to indicate which movement is desired, and then press a button to activate the actuator 50 and cause the movement to occur. Accordingly, in some embodiments, a user may bring the climbing surface 13 into and out of an inclined orientation with no physical exertion.

For example, the system climbing wall assembly 10 may comprise a user interface panel. Alternatively (or additionally), a user may activate the actuator 50 using a remote control. The remote control may be connected to the assembly 10 via a cord or the remote control may be wirelessly connected to the system. A docking station for the remote control may be provided on the climbing wall assembly 10. In some embodiments, a user may activate the actuator 50 remotely through a data processing unit or processor, such as one associated with a personal computer, a tablet computer, a smartphone, or the like.

It is also contemplated that the actuator 50 could be operated manually, such as through a variety of mechanical actuating systems. Manual activation may be included as a back-up system, e.g. in case of failure of the automatic system, or it may be the primary system by which the incline of the climbing surface 13 is adjusted.

Figure 5:
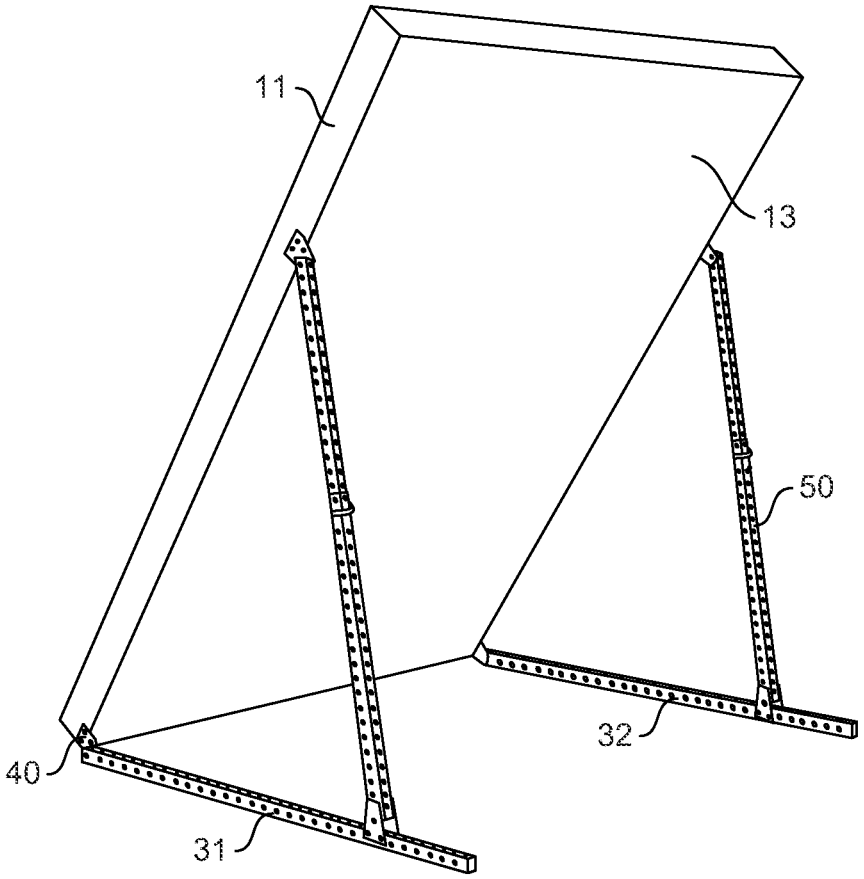
FIG. 5 is a front perspective view of another embodiment of a climbing wall in which the actuator comprises a pair of manually settable tube struts, showing the climbing surface at an incline of about 20° from vertical.
Figure 6:
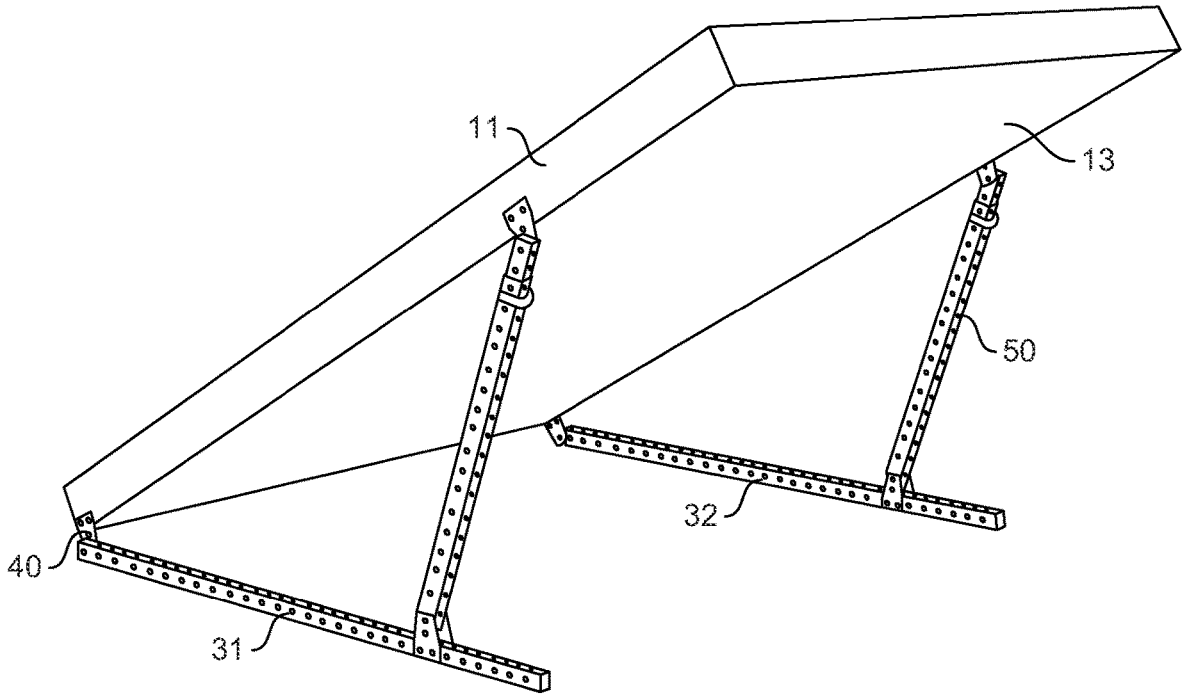
FIG. 6 is a front perspective view of the embodiment of FIG. 5, showing the climbing surface an incline of about 60° from vertical.

In some embodiments, for example, the actuator 50 may comprise one or more manually set tube struts, such as those shown in FIGS. 5-6. The tube struts may comprise first and second tube elements, wherein the first tube element is received in the second tube element in a telescoping, or at least partially telescoping, manner. Each of the first and second tube elements may also comprise a plurality of apertures, e.g. through-holes. When the apertures in the first tube element are aligned with the apertures in the second tube element, a pin (such as a weight stack pin common to exercise equipment) may be placed into the aligned apertures, thereby locking the first and second tube elements together at a defined position. As shown in FIGS. 5-6, a user may thus manually adjust the incline of the climbing surface 13 using a tube strut actuator 50 of this sort by (i) removing the one or more pins that had locked the first and second tube elements together to provide the tube strut with a first length, (ii) sliding the first tube element into the second tube element (to reduce the length of the tube strut, which in the illustrated embodiment would increase the angle of the climbing surface relative to vertical) or out of the second tube element (to increase the length of the tube strut, which in the illustrated embodiment would decrease the angle of the climbing surface relative to vertical), and (iii) inserting the one or more pins through the aligned apertures, thereby locking the first and second tube elements together to provide the tube strut with a second length.

In other embodiments, the actuator 50 may comprise a hand crank, e.g. a hand crank that may be associated with a cable and/or pulley system. A user could thus operate the hand crank to operate the cable and/or pulley system, causing the angle of the climbing surface 13 to either increase or decrease, as desired. In other embodiments, the hand crank could be operably associated with any of the linear actuators described herein. The hand crank could be disposed anywhere on the climbing wall assembly 10, most desirably at a location where it would not interfere with the climbing experience.

Figure 7:
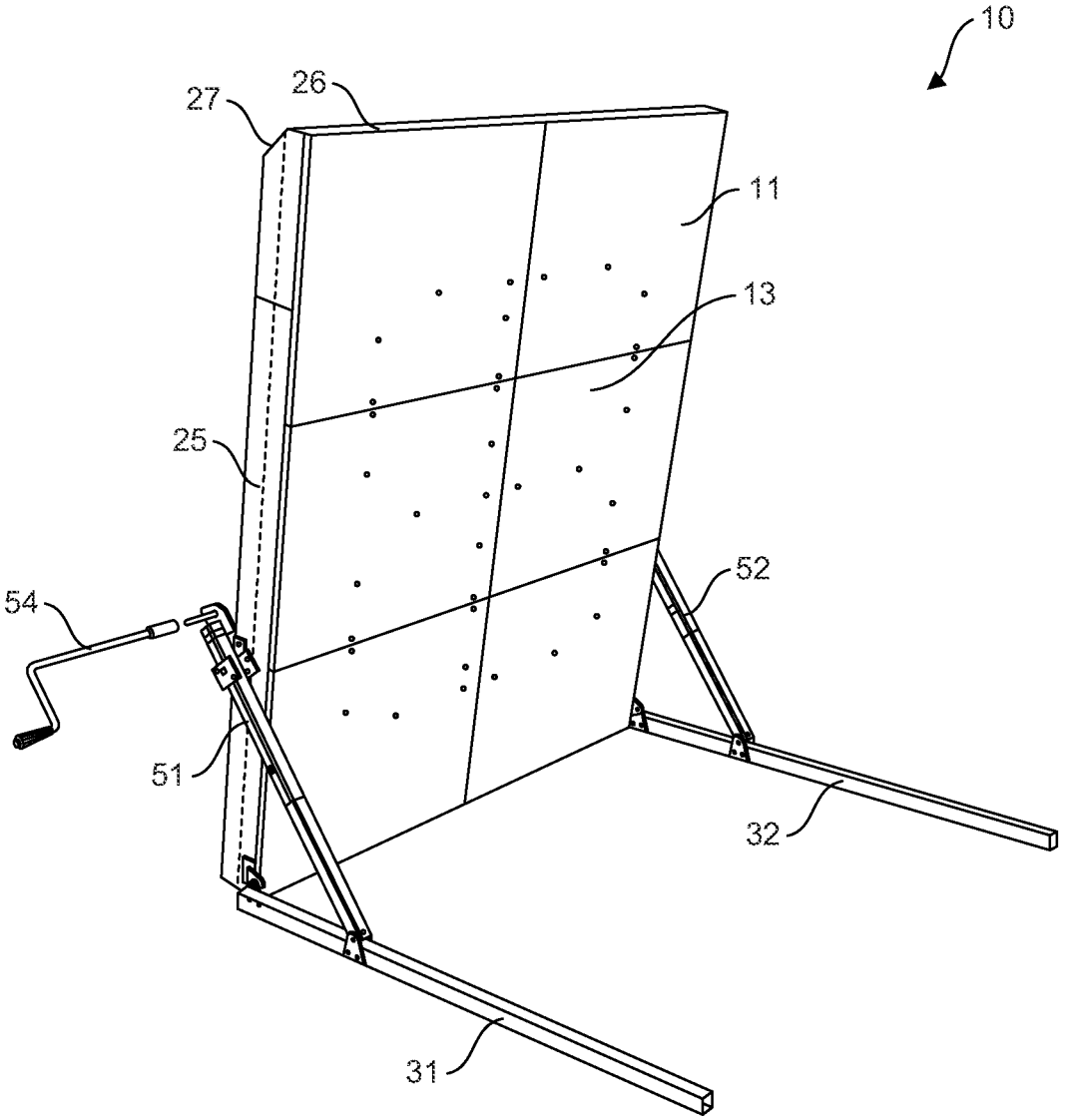
FIG. 7 is a front perspective view of another embodiment of a climbing wall in which the actuator comprises a pair of jacks operated by a hand crank, showing the climbing surface at an incline of about 20° from vertical.
Figure 8:
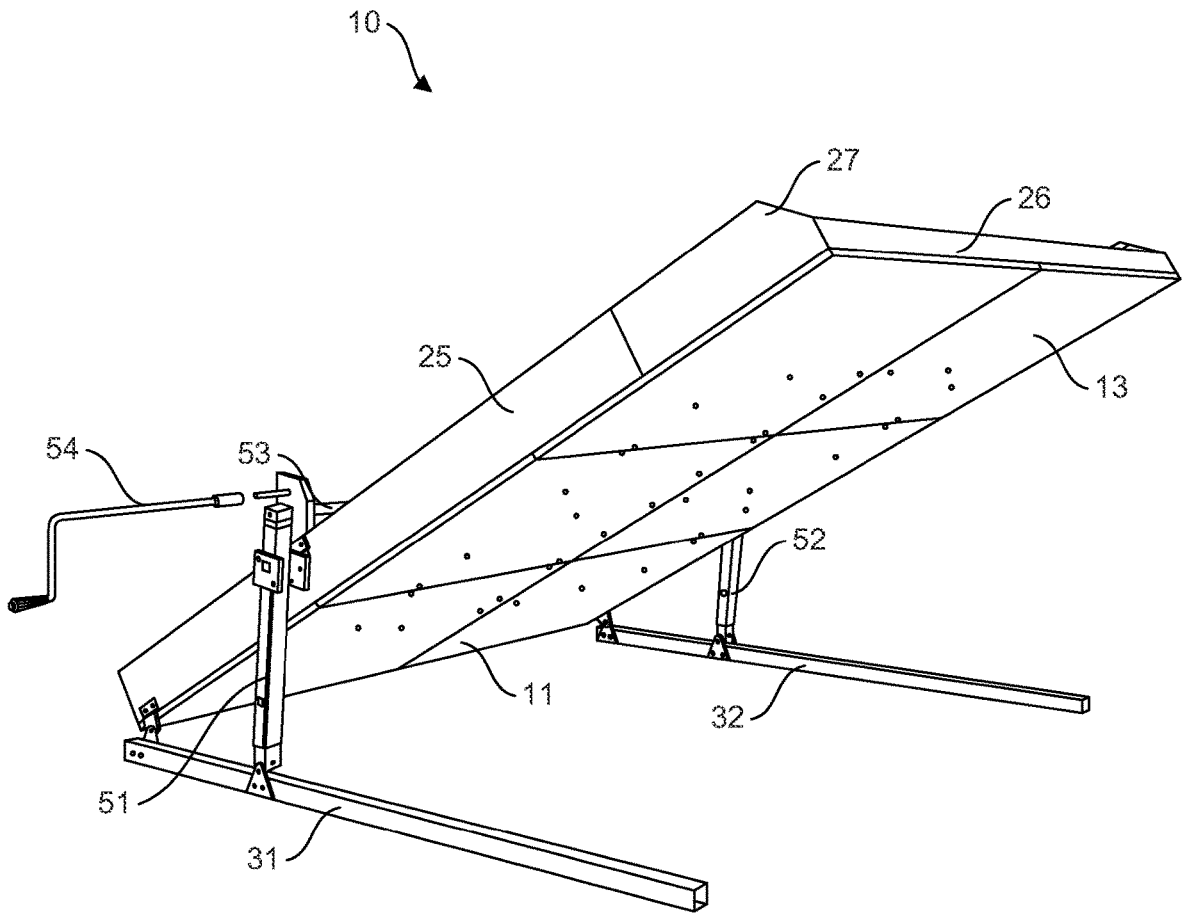
FIG. 8 is a front perspective view of the embodiment of FIG. 7, showing the climbing surface an incline of about 60° from vertical.
Figure 9:
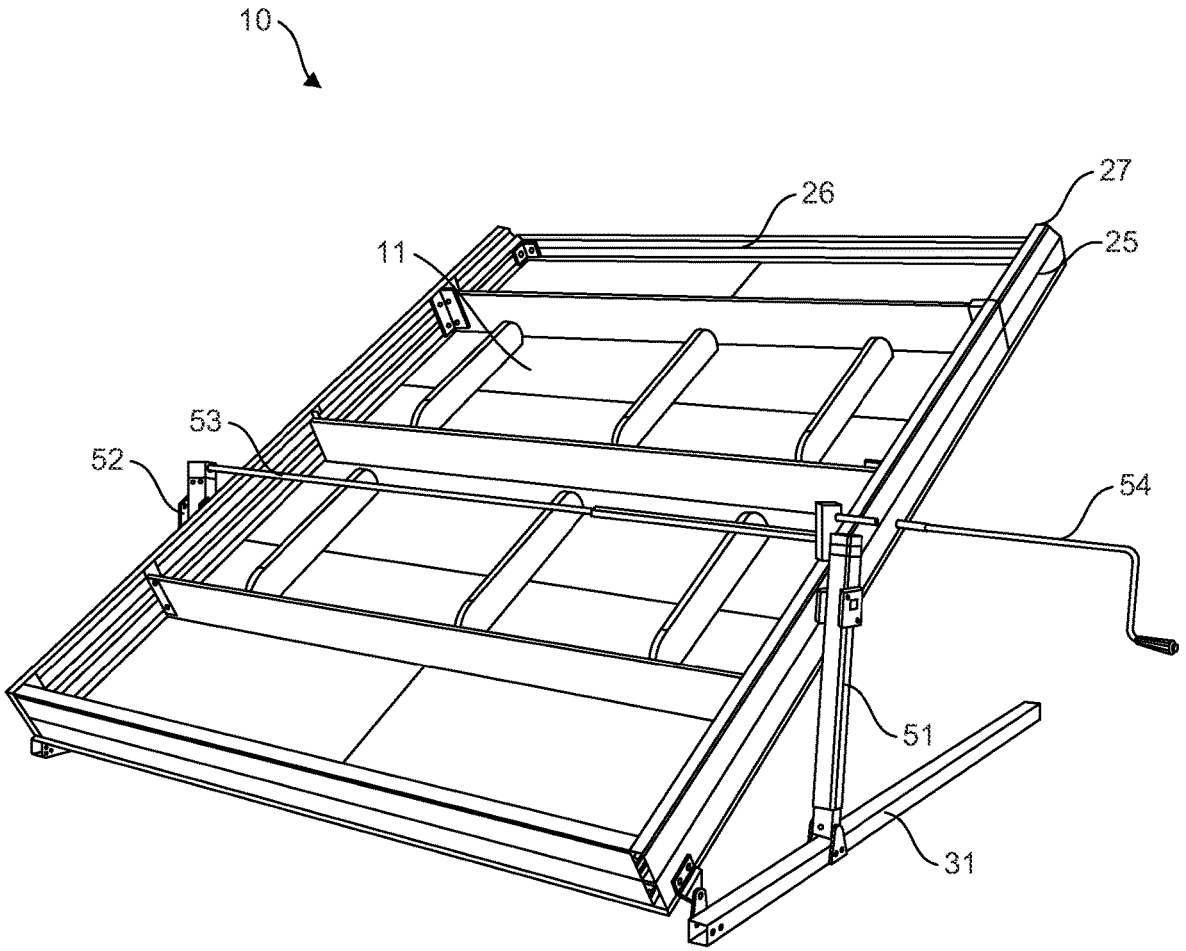
FIG. 9 is a rear perspective view of the embodiment of FIG. 7, showing the climbing surface an incline of about 60° from vertical.

One example of such an embodiment is shown in FIGS. 7 to 9. In this embodiment, the actuator 50 comprises a pair of jacks that are operated by a hand crank. The jacks may be specially configured for the climbing wall assembly 10 or commercially available jacks, e.g. trailer landing jacks, may be reconfigured to connect to the elements of the climbing wall assembly 10 and operate with the climbing wall assembly. The jacks may each comprise an inner element that telescopes into an outer element, e.g. by way of a threaded rod. A first jack 51 may be hingedly attached to both a first leg 31 and a portion of the wall frame, e.g. a side frame element 25. Similarly, a second jack 52 may be hingedly attached to both a second leg 32 and a portion of the wall frame, e.g. an opposite side frame element 25. The first jack 51 and the second jack 52 may be operably connected by a rotating shaft 53, which runs behind the one or more climbing panels 11. The rotating shaft 53 ensures that the first and second jacks 51, 52 operate in synchronization to bring the climbing surface 13 to a desired angle of incline.

At least one of the first and second jacks, and optionally both, may either comprise a hand crank 54 or be configured to receive a hand crank. Using the hand crank 54, a user may move the climbing surface 13 within the permitted range of angles. In contrast to the embodiment shown in FIGS. 5-6, a user may stop rotation of the hand crank at any time, meaning that any angle of incline within the permitted range may be obtained, i.e. the climbing surface angles are not limited to a plurality of fixed points. In some embodiments, the actuator 50 may comprise one or more electric motors, either in place of or in addition to a hand crank, by which the first and second jacks 51, 52 may be operated electronically.

Though the embodiment shown in FIGS. 7 to 9 is shown without the pivot system or kickboard shown in FIGS. 1-4, it is to be understood that any of the elements and/or features of the embodiment shown in FIGS. 1-4 could be incorporated into the embodiment shown in FIGS. 7-9, and vice versa.

In some embodiments, each of the one or more actuators 50 has a first end and a second end, the first end being connected to one of the first and second legs 31, 32 and the second end being connected to a portion of the wall frame such as the upper frame element 22. The first end of the actuator 50 may be hingedly (e.g. rotatably) connected to the first or second leg 31, 32; the second end of the actuator may be hingedly (e.g. rotatably) connected to a portion of the wall frame such as the upper frame element 22; or both. In some embodiments, such as that illustrated in FIGS. 1-4 for instance, the system may include a first actuator 50 and a second actuator, the first actuator being connected to the first leg 31 and the second actuator being connected to the second leg 32.

In some embodiments, the first end of each actuator 50 may be connected to the first or second leg 31 in the front region of the leg, e.g. within the front half of the leg, more desirably within the front third of the leg, more desirably within the front quarter of the leg. In this manner, the actuators 50 may also help support and stabilize the climbing wall by distributing the forces placed on the climbing surface 13 to a forward region of the legs 31, 32. Such a distribution of weight to a forward portion of the support legs 31, 32 may be particularly important when the climbing surface 13 is placed at higher angles relative to vertical. In some embodiments, for instance, when the climbing surface 13 is at a high angle relative to vertical, e.g. the highest angle within the permitted range, the one or more actuators 50 (each of which is capable of withstanding at least a minimum required amount of force, as described above), may be oriented substantially vertically, as shown for example in FIGS. 3 and 4. This provides the climbing wall assembly 10 with significant stability, which may otherwise be difficult to achieve when the climbing surface 13 is placed at high angles relative to vertical.

As described above, and shown in the embodiment illustrated in FIGS. 1-4, a first end of the upper frame element 22 may include a portion 23 that extends outward beyond a first side of the climbing surface 13 and a second end of the upper frame may include a portion that extends outward beyond a second side of the climbing surface. The actuators 50 may be connected to the extending portions 23 of the frame elements 22, such that the actuators are aligned with the direction in which the climbing surface 13 pivots. In other embodiments, e.g. where the first and second legs 31, 32 are not angled outward, the actuators 50 may be connected to the end of upper frame element 22 at or near the side of the climbing surface 13.

Referring to the embodiment illustrated in FIGS. 1-4, by activating the actuator 23, a user may adjust the incline of the climbing surface 13 so that the climbing surface is inclined at any of a plurality of angles within the permitted range of movement. Once the climbing surface 13 has been placed at the desired angle, a user may simply deactivate the actuator 23. Because the system employs a high-strength actuator 23, which is capable of withstanding forces placed on the climbing wall during use in the inclined position, a user may enjoy the activities presented by the climbing wall without concern for unintended movement of the wall during use. When a user is finished using the climbing wall 10 at a desired angle of incline, a user may again simply activate the actuator 23, causing it to retract toward a more vertical position. In other embodiments, the climbing assembly 10 may further comprise one or more locking mechanisms for locking the climbing surface 13 at a desired angle.

As described above, in some embodiments, the pivot point(s) 40 upon which the climbing wall (the one or more panels 11 that make up the climbing surface 13 and, if present, the framework attached to the rear of the panels) pivots may be placed forward of the bottom edge 15 of the climbing surface 13. One such embodiment is shown in FIGS. 1-4. By placing the pivot points 40 forward of the bottom edge 15 of the climbing surface 13, embodiments of the climbing wall assembly 10 may provide a climbing surface in which an increased span, and desirably the entire span, between the top edge 14 and the bottom edge 15 may be usable by a climber regardless of the selected angle of incline. In some embodiments, for example, at least 80% of the span between the top edge 14 and the bottom edge 15 of the climbing surface is accessible to a climber when the climbing surface 13 is placed at its maximum permitted angle relative to vertical, alternatively at least 85%, alternatively at least 90%, alternatively at least 95%, alternatively 100%. At the same time, because the bottom edge 15 of the climbing surface 13 may be placed close to a the ground surface on which the assembly 10 is installed, the overall height of the climbing wall assembly may be kept relatively low, enabling its use home environments where ceiling height may be a limiting factor.

Embodiments of the climbing wall assembly 10 disclosed herein are configured to raise the bottom edge 15 of the climbing surface 13 when it is brought to higher angles relative to vertical, thereby eliminating the unusable dead space that would be created if the bottom edge 15 were close to the ground surface (as would be the case if the pivot point were positioned at the bottom edge 15 of the climbing surface). By raising the bottom edge 15 of the climbing surface, the assembly 10 may maximize the span of climbing surface (measured in the direction between the top edge 14 and the bottom edge 15) available to a climber when the climbing surface 13 is placed at higher angles. In this way, embodiments of the climbing wall assembly 10 maximize the span of climbing surface 13 available to a climber, e.g. by making the same, or substantially the same, span of climbing surface available throughout the permitted range of climbing surface inclines.

Embodiments of the climbing wall assembly 10 disclosed herein are also configured to lower the bottom edge 15 of the climbing surface 13 when it is brought to lower angles relative to vertical, thereby reducing the total overall height requirements of the climbing wall assembly (since the upper edge 14 of the climbing surface 13 is at its highest point when the climbing surface is oriented vertically, or as close to vertical as is permitted). In this way, the span of climbing surface 13 (in the direction between the top edge 14 and the bottom edge 15) that may be installed within a particular room having a fixed ceiling height may be maximized.

In some embodiments, for instance, the bottom edge of the climbing surface 15 may be positioned at least 8 inches above the ground surface when the climbing surface 13 is placed at its highest permitted angle relative to vertical, alternatively at least 10 inches above the ground surface when the climbing surface is placed at its highest permitted angle relative to vertical, alternatively at least 12 inches above the ground surface when the climbing surface is placed at its highest permitted angle relative to vertical, alternatively at least 14 inches above the ground surface when the climbing surface is placed at its highest permitted angle relative to vertical, alternatively at least 15 inches above the ground surface when the climbing surface is placed at its highest permitted angle relative to vertical, alternatively at least 16 inches above the ground surface when the climbing surface is placed at its highest permitted angle relative to vertical, alternatively at least 17 inches above the ground surface when the climbing surface is placed at its highest permitted angle relative to vertical, alternatively at least 18 inches above the ground surface when the climbing surface is placed at its highest permitted angle relative to vertical. In the embodiment illustrated in FIG. 1-4, for example, the bottom edge of the climbing surface 15 is positioned about 19 inches above the ground surface when the climbing surface 13 is placed at its highest permitted angle relative to vertical.

In any of those same embodiments, the bottom edge of the climbing surface 15 may be positioned within 12 inches of the ground surface when the climbing surface 13 is placed at its lowest permitted angle relative to vertical, alternatively within 10 inches of the ground surface when the climbing surface is placed at its lowest angle relative to vertical, alternatively within 8 inches of the ground surface when the climbing surface is placed at its lowest angle relative to vertical, alternatively within 6 inches of the ground surface when the climbing surface is placed at its lowest angle relative to vertical, alternatively within 5 inches of the ground surface when the climbing surface is placed at its lowest angle relative to vertical, alternatively within 4 inches of the ground surface when the climbing surface is placed at its lowest angle relative to vertical, alternatively within 3 inches of the ground surface when the climbing surface is placed at its lowest angle relative to vertical, alternatively within 2 inches of the ground surface when the climbing surface is placed at its lowest angle relative to vertical. In the embodiment illustrated in FIGS. 1-4, for example, the bottom edge of the climbing surface 15 is positioned about 1 inch above the ground surface when the climbing surface 13 is placed at its lowest permitted angle relative to vertical.

In some embodiments, for instance, the bottom edge of the climbing surface 15 may be at least 12 inches above the ground surface when the climbing surface 13 is placed at its highest permitted angle relative to vertical and less than 12 inches of the ground surface when the climbing surface is placed at its lowest permitted angle. In some embodiments, for instance, the bottom edge of the climbing surface 15 may be at least 12 inches above the ground surface when the climbing surface 13 is placed at its highest permitted angle relative to vertical and within 6 inches of the ground surface when the climbing surface is placed at its lowest permitted angle. In some embodiments, for instance, the bottom edge of the climbing surface 15 may be at least 12 inches above the ground surface when the climbing surface 13 is placed at its highest permitted angle relative to vertical and within 3 inches of the ground surface when the climbing surface is placed at its lowest permitted angle. In some embodiments, for instance, the bottom edge of the climbing surface 15 may be at least 15 inches above the ground surface when the climbing surface 13 is placed at its highest permitted angle relative to vertical and within 12 inches of the ground surface when the climbing surface is placed at its lowest permitted angle. In some embodiments, for instance, the bottom edge of the climbing surface 15 may be at least 15 inches above the ground surface when the climbing surface 13 is placed at its highest permitted angle relative to vertical and within 6 inches of the ground surface when the climbing surface is placed at its lowest permitted angle. In some embodiments, for instance, the bottom edge of the climbing surface 15 may be at least 15 inches above the ground surface when the climbing surface 13 is placed at its highest permitted angle relative to vertical and within 3 inches of the ground surface when the climbing surface is placed at its lowest permitted angle.

In some embodiments, for instance, the bottom edge 15 of the climbing surface 13 may be positioned at least 12 inches above the ground surface (upon which the climbing wall assembly 10 is installed) when the climbing surface is placed at a 60° angle relative to vertical, alternatively at least 14 inches above the ground surface, alternatively at least 16 inches above the ground surface. In any of those same embodiments, the bottom edge 15 of the climbing surface 13 may be positioned within 8 inches of the ground surface (upon which the climbing wall assembly 10 is installed) when the climbing surface is placed at a 20° angle relative to vertical, alternatively within 6 inches of the ground surface, alternatively within 4 inches of the ground surface, alternatively within 2 inches of the ground surface.

Figure 2:
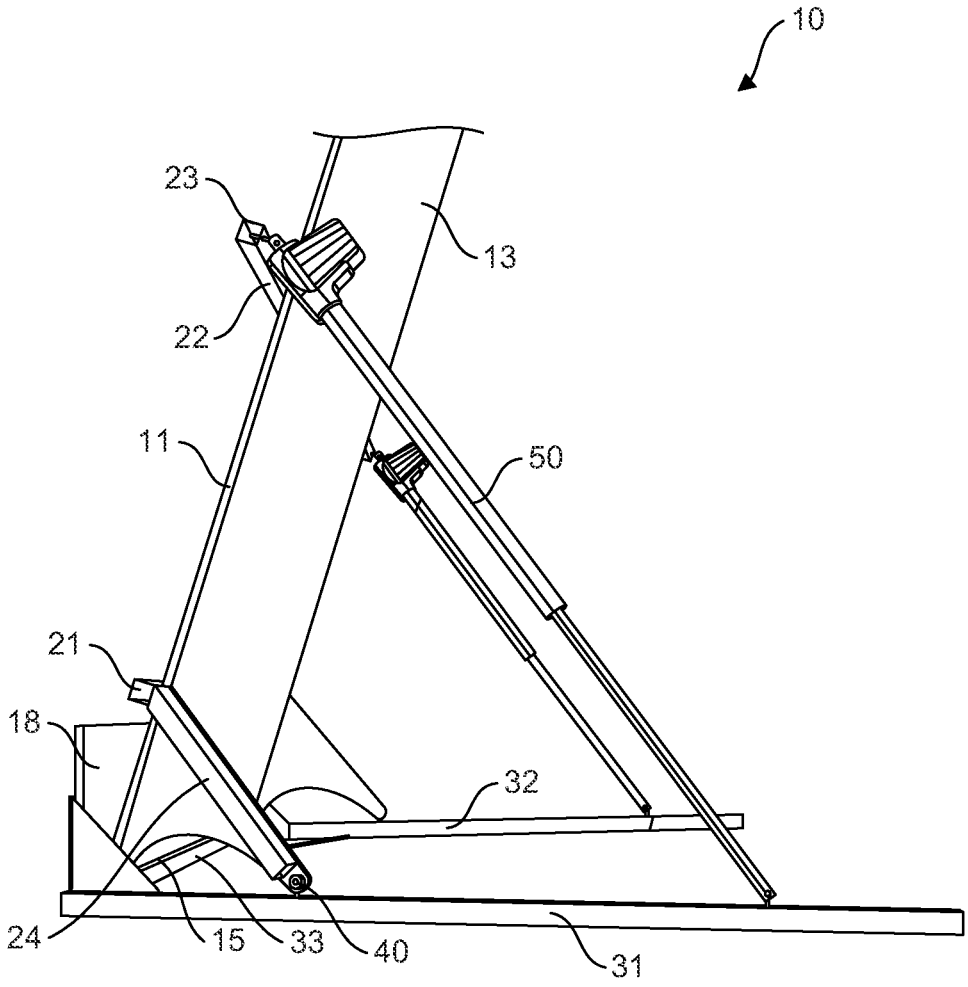
FIG. 2 is a side perspective view of the embodiment of FIG. 1, showing the climbing surface at an incline of about 20° from vertical.
Figure 3:
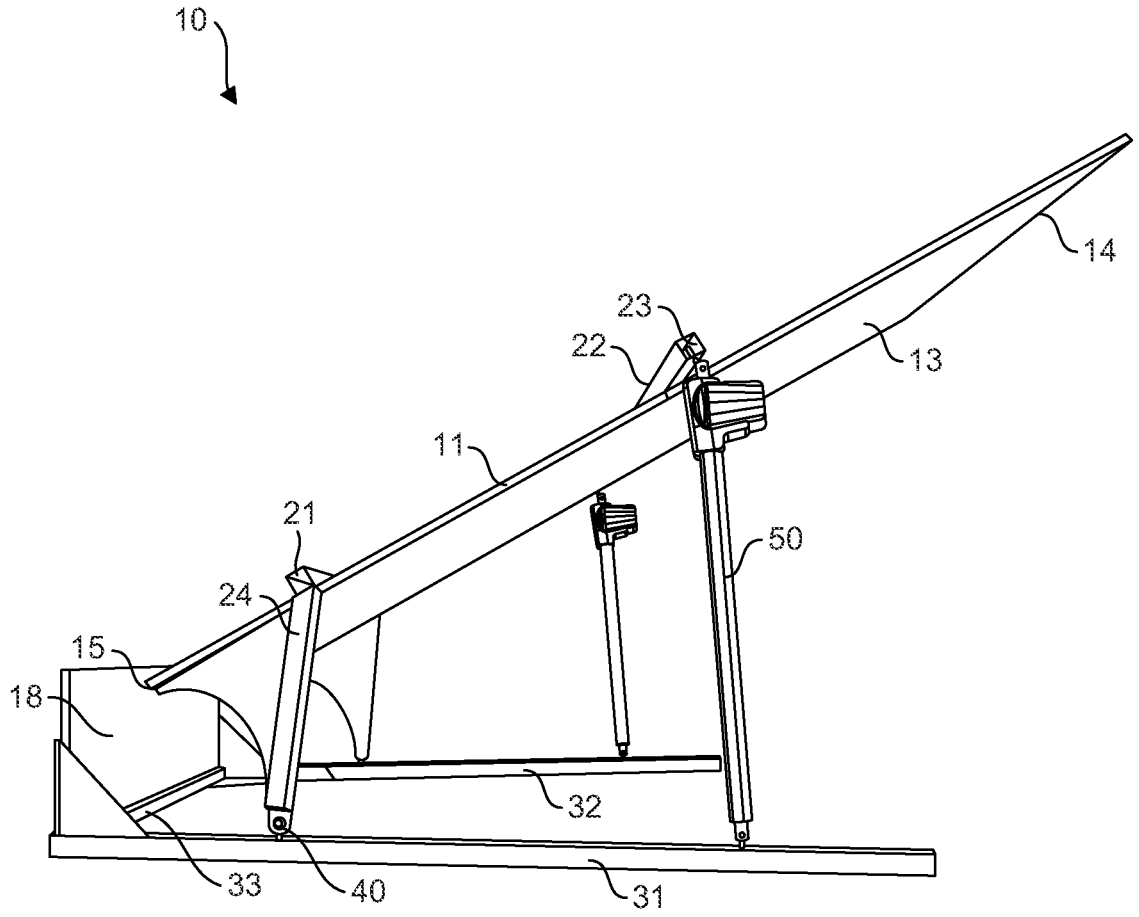
FIG. 3 is a side perspective view of the embodiment of FIG. 1, showing the climbing surface at an incline of about 60° from vertical.
Figure 4:
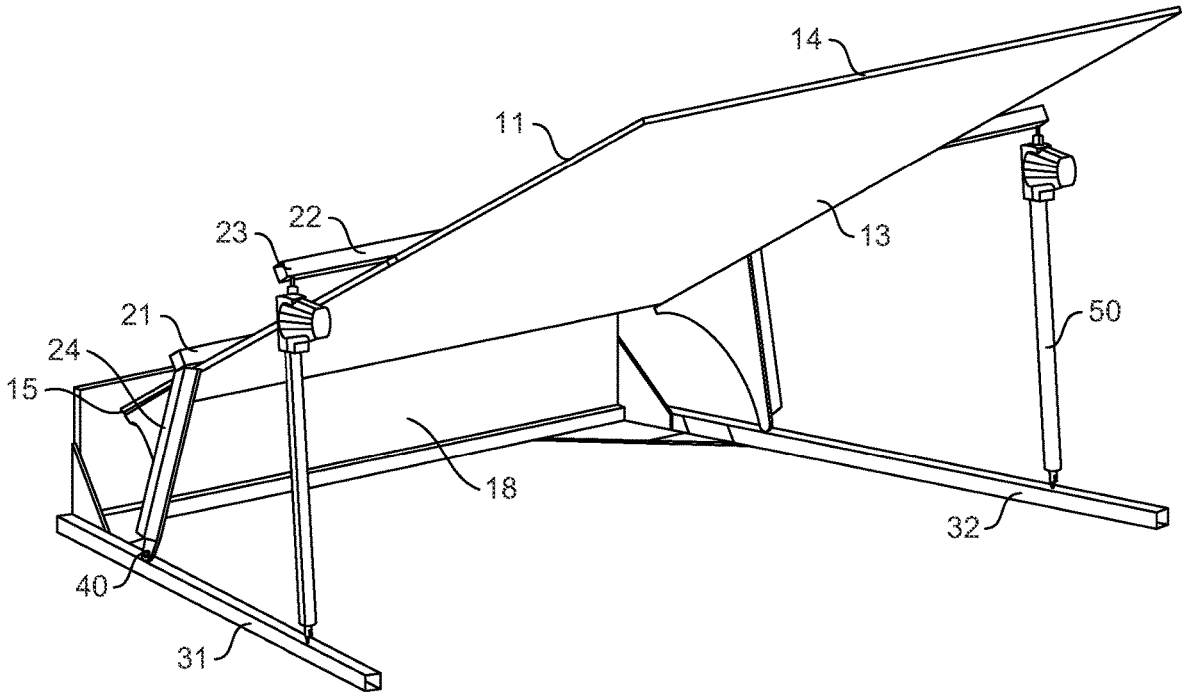
FIG. 4 is a front perspective view of the embodiment of FIG. 1, showing the climbing surface at an incline of about 60° from vertical.

In the embodiment illustrated in FIGS. 1-4, for example, the bottom edge 15 of the climbing surface 13 is positioned about 1 inch above the ground surface when the climbing surface is placed at a 20° angle relative to vertical as shown in FIGS. 1-2 and the bottom edge of the climbing surface is positioned about 19 inches above the ground surface when the climbing surface is placed at a 60° angle relative to vertical as shown in FIGS. 3-4. As the climbing surface 13 is brought to higher angles, the bottom edge 15 of the climbing surface is brought to successively higher elevations above the ground surface. For instance, in the embodiments illustrated in FIGS. 1-4, as the climbing surface 13 is brought to a 30° angle relative to vertical, the bottom edge 15 of the climbing surface is positioned about 5.5 inches above the ground surface; as the climbing surface is brought to a 40° angle relative to vertical, the bottom edge of the climbing surface is positioned about 11 inches above the ground surface; as the climbing surface is brought to a 50° angle relative to vertical, the bottom edge of the climbing surface is positioned about 16.5 inches above the ground surface, and the like.

In some embodiments, when the climbing surface 13 is brought to a 20° angle relative to vertical, the bottom edge 15 of the climbing surface may positioned within 4 inches of the ground surface, alternatively within 3 inches of the ground surface, alternatively within 2 inches of the ground surface. In some embodiments, when the climbing surface 13 is brought to a 30° angle relative to vertical, the bottom edge 15 of the climbing surface may positioned at least 3 inches above the ground surface, alternatively at least 4 inches above the ground surface, alternatively at least 5 inches above the ground surface (e.g. between 3 and 8 inches above the ground surface, alternatively between 4 and 7 inches above the ground surface). In some embodiments, when the climbing surface 13 is brought to a 40° angle relative to vertical, the bottom edge 15 of the climbing surface may positioned at least 7 inches above the ground surface, alternatively at least 8 inches above the ground surface, alternatively at least 9 inches above the ground surface (e.g. between 7 and 15 inches above the ground surface, alternatively between 8 and 14 inches above the ground surface, alternatively between 9 and 13 inches above the ground surface). In some embodiments, when the climbing surface 13 is brought to a 50° angle relative to vertical, the bottom edge 15 of the climbing surface may positioned at least 12 inches above the ground surface, alternatively at least 13 inches above the ground surface, alternatively at least 14 inches above the ground surface (e.g. between 12 and 21 inches above the ground surface, alternatively between 13 and 20 inches above the ground surface, alternatively between 14 and 19 inches above the ground surface). In some embodiments, when the climbing surface 13 is brought to a 60° angle relative to vertical, the bottom edge 15 of the climbing surface may positioned at least 15 inches above the ground surface, alternatively at least 16 inches above the ground surface, alternatively at least 17 inches above the ground surface (e.g. between 15 and 24 inches above the ground surface, alternatively between 16 and 23 inches above the ground surface, alternatively between 17 and 22 inches above the ground surface).

In some embodiments, the wall frame may comprise an upper element 26 and/or side elements 25 that extend some distance rearward of the climbing surface 13. As a result, as the climbing wall is moved from its most upright (i.e. least inclined) position downward toward a greater angle of incline, the upper wall frame element 26 and/or the top of the wall frame side elements 25 may become the highest point of the climbing wall assembly 10. In some embodiments, the upper wall frame element 26 may be angled downward or comprise a portion, e.g. a rearmost portion, that is angled downward. Similarly, as shown in the embodiment illustrated in FIGS. 7-9, the tops of the wall frame side elements 25 may be angled downward or comprise a portion, e.g. a rearmost portion 27, that is angled downward. By providing the upper wall frame element 26 and/or the wall frame side elements 25 with this downward angle, the overall height requirements of the climbing wall assembly may be reduced. This may facilitate the wall to be installed in a room (e.g. a basement or a garage) having a lower fixed ceiling height than would otherwise be possible. While the embodiments illustrated in FIGS. 1-4 is shown as not having a wall frame comprising top or side frame elements 26, 25, it is noted that such wall frame elements may be present and that the downward angle described above (and shown in the embodiment illustrated in FIGS. 7-9) may be utilized to further minimize the overall height requirements of the climbing wall assembly 10.

In some embodiments, the adjustable-incline climbing wall assembly 10 may be a freestanding unit. By this, it is meant that the climbing wall assembly 10 need not be secured to a ground surface, e.g. a floor, or a structural support wall by fasteners or the like. In this manner, embodiments of the climbing wall assembly 10 may be installable in a climber's home or personal gym without requiring any modification or damage, e.g. the drilling of holes, to floors or walls. In other embodiments, however, the climbing wall assembly 10 may be configured to be secured to a ground surface on which it is installed and/or a structural support wall.

Embodiments of the adjustable-incline climbing wall 10 may also be configured to have minimal space requirements. In some embodiments, for example, when the climbing surface 13 is at its lowest angle relative to vertical, the bottom edge 15 of the climbing surface may be within 12 inches of the rearmost point of the climbing wall assembly 10, alternatively within 10 inches of the rearmost point of the climbing wall assembly, alternatively within 8 inches of the rearmost point of the climbing wall assembly, alternatively within 6 inches of the rearmost point of the climbing wall assembly, alternatively within 4 inches of the rearmost point of the climbing wall assembly. In this manner, embodiments of the climbing wall assembly 10 may be installed in rooms having relatively small dimensions/square footage, making it suitable for installation in homes in which space may be at a premium.

In some embodiments, the climbing wall assembly 10 may also comprise a plurality of lights on the climbing surface 13. For example, the climbing surface 13 may contain a small LED light adjacent to, and visually associated with, each climbing grip 12 or aperture to which a climbing grip may be attached. Therefore, a preset climbing route may be designated through control over which lights are illuminated. Notably, the ability of an assembly 10 to adjust the incline of the climbing surface 13 in combination with the ability of the assembly to illuminate a preset climbing route allows for a user to select from countless climbing challenges, such as may be stored in a database. Upon selection of a climbing challenge, a control unit or processor may both (a) cause the actuator 50 to bring the climbing surface 13 to the specific incline associated with the selected climbing challenge and (b) illuminate the lights associated with the grips 12 that are used in the climbing route associated with the selected climbing challenge. In some embodiments, a user may also create a new climbing challenge, having both a designated incline aspect and a signified climbing route aspect, which may then be stored in the climbing challenge database.

In some embodiments of the climbing wall assembly 10, the one or more climbing panels 11 comprise a plurality of apertures into which the plurality of climbing grips 12 may be affixed, such as through the conventional use of T-nuts. In some embodiments of the climbing wall assembly 10 disclosed herein, however, one or more of the climbing grips 12 may be more easily attachable to and removable from the climbing surface 13. One example of easily removable climbing grips 12 that may be suitable for use with the adjustable climbing wall assembly 10 of the present disclosure is described in United States Patent Application Publication No. US 2019/0009157 A1, the entirety of which is incorporated by reference herein.

In some embodiments, the climbing wall assembly 10, and more particularly the climbing surface 13, may also comprise one or more fitness accessories and/or panels, including for instance those described in United States Patent Application Publication No. US 2019/0009157 A1, the entirety of which is incorporated by reference herein.

It can be seen that the described embodiments provide a unique and novel climbing wall assembly 10 that has a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. An adjustable-incline climbing wall assembly comprising:

a. one or more climbing panels configured to provide a climbing surface;

b. a plurality of climbing grips affixed to the climbing surface;

c. a system for supporting and adjusting the incline of the climbing surface, the system comprising i. one or more frame elements affixed to at least one of the one or more climbing panels;

ii. a support structure comprising a first forward-extending leg and a second forward-extending leg, the one or more frame elements being pivotably connected to the support structure;

iii. first and second actuators configured to adjust the incline of the climbing surface to a plurality of angles within a permitted range, the first actuator being connected to both the first leg and at least one of the one or more frame elements and the second actuator being connected to both the second leg and at least one of the one or more frame elements; and iv. a hand crank configured to operate the first and second actuators.

2. The adjustable-incline climbing wall assembly of claim 1, wherein the first and second actuators are operably connected by a rotatable shaft, such that they move in synchronization in response to operation of the hand crank.

3. The adjustable-incline climbing wall assembly of claim 2, wherein the rotatable shaft runs behind the one or more climbing panels.

4. The adjustable-incline climbing wall assembly of claim 1, wherein each of the first and second actuators comprises an inner element that telescopes into an outer element.

5. The adjustable-incline climbing wall assembly of claim 1, wherein each of the first and second actuators is a jack.

6. The adjustable-incline climbing wall assembly of claim 1, wherein the hand crank is removable.

7. The adjustable-incline climbing wall assembly of claim 1, wherein the one or more frame elements comprise side elements that extend rearward of the climbing surface, wherein the top of each of the side elements comprises a portion that is angled downward to reduce the overall height requirements of the assembly.

8. The adjustable-incline climbing wall assembly of claim 1, wherein the permitted range of angles includes at least a range between 20° and 60° relative to vertical.

9. The adjustable-incline climbing wall assembly of claim 1, wherein the lowest permitted angle relative to vertical is between 5° and 20°.

10. The adjustable-incline climbing wall assembly of claim 1, wherein the adjustable-incline climbing wall assembly is a freestanding unit.

11. The adjustable-incline climbing wall assembly of claim 1, wherein when the climbing surface is at its highest angle relative to vertical, the one or more actuators are oriented substantially vertically.

12. The adjustable-incline climbing wall assembly of claim 1, wherein the space directly underneath the climbing surface is free of obstruction by any portion of the support structure.

13. The adjustable-incline climbing wall assembly of claim 1, wherein the first leg and the second leg are angled outward, such that the distance between a front end of the first leg and a front end of the second leg is greater than the distance between a rear end of the first leg and a rear end of the second leg.

14. The adjustable-incline climbing wall assembly of claim 13, wherein the one or more frame elements comprises an actuator-supporting frame element; and wherein a first end of the actuator-supporting frame element extends outward beyond a first side of the climbing surface and a second end of the actuator-supporting frame element extends outward beyond a second side of the climbing surface, such that each of the first and second actuators are aligned with the direction in which the climbing surface pivots.

15. The adjustable-incline climbing wall assembly of claim 1, wherein the one or more frame elements are pivotably connected to each of the first leg and the second leg at a point positioned in front of a bottom edge of the climbing surface.

* * * * *